United States Patent [19]

Roberts

[11] Patent Number: 4,674,730

[45] Date of Patent: Jun. 23, 1987

[54] ALIGNING RAIL ENDS FOR WELDING

[75] Inventor: Jeff Roberts, Ile des Chenes, Canada

[73] Assignee: Jeff Roberts, Winnipeg, Canada; a part interest

[21] Appl. No.: 843,643

[22] Filed: Mar. 25, 1986

[30] Foreign Application Priority Data

Apr. 2, 1985 [CA] Canada ..... 478209

[51] Int. Cl.[4] ..... B25B 1/20

[52] U.S. Cl. ..... 269/43; 269/60; 269/69; 269/152

[58] Field of Search ..... 269/43, 60, 69, 152; 254/43, 44

[56] References Cited

U.S. PATENT DOCUMENTS 1,405,113 1/1922 Gwinn ..... 254/43
2,398,116 4/1946 Roy ..... 254/43
2,846,761 8/1958 Evans ..... 269/69
4,283,828 8/1981 Cole ..... 269/60

*Primary Examiner*—Robert C. Watson
*Attorney, Agent, or Firm*—Adrian D. Battison; Stanley G. Ade

[57] ABSTRACT

A device for aligning rail ends for welding of the abutting rail ends comprises a pair of clamping members which extend across from the rail to be welded to the adjacent continuous portion of rail including a telescopic member which can be expanded to abut plates at the ends thereof with the web of the rail and clamping members which extend over and around the rail to clamp the other side of the web. A jacking screw acts to lock the telescopic member in the required gauge spacing and also to jack the clamping member upwardly to locate the rail end at the required elevation.

6 Claims, 3 Drawing Figures

ALIGNING RAIL ENDS FOR WELDING

BACKGROUND OF THE INVENTION

This invention relates to an apparatus and method for aligning rail ends for welding.

Railway tracks as is well known include a pair of parallel spaced rails mounted on ties at an accurate pre-determined spacing or gauge so that the rolling stock can run along the rails. Each rail has an upper rail head on which the wheel runs and a flange or base which engages the ties, together with a web of reduced transversed dimension inter-connecting the base and the head. Since the early development of rails, these have been supplied in finite lengths each of which is separately attached to the ties and is coupled to the next adjacent length with a spacing to accommodate expansion of the rails. There are many thousands of miles of such rails presently laid and in use in Canada and in other countries.

It has long been known that the junctions between the rail lengths cause excessive vibration on the wheels and rolling stock which rapidly causes wear and damage to the rolling stock. Programs have therefore recently been undertaken to weld the adjacent rail ends together to form effectively a continuous rail thus eliminating the characteristic and damaging vibration of the rolling stock crossing the junctions. The welding technique has become well established and uses what is known as a thermite weld which is a chemical welding technique obtained by placing a mold around the adjacent rail ends in which a chemical welding technique takes place.

However, techniques for accurately aligning the rail ends prior to welding are generally very crude. These include manual wedging of the rails at the required location prior to the attachment of the mold for the thermite weld. Specifically designed devices are available for aligning the rail ends but these are complex, expensive and difficult to use and have therefore met with little success.

SUMMARY OF THE INVENTION

It is one object of the present invention, therefore, to provide an improved apparatus and method for aligning rail ends prior to welding.

According to the invention, therefore, there is provided an apparatus for aligning adjacent ends of rail lengths of one rail of a railway track, of the type having a pair of parallel spaced discontinuous rails in which junctions between the rail lengths of said one rail are longitudinally offset from junctions between rail lengths of the other rail of the pair for welding of the adjacent ends to form a continuous rail, the apparatus comprising a first and a second spacing member each member including means for engaging said one rail and said other rail and spacing said one rail for said other rail by a pre-determined distance, and means for clamping said one rail at said pre-determined distance whereby said first and second members can be arranged on respective sides of said adjacent ends spaced therefrom to allow welding of said adjacent ends.

According to a second aspect of the invention there is provided an apparatus for use in aligning adjacent ends of rail lengths of one rail of a railway track, of the type having a pair of parallel spaced discontinuous rails in which junctions between rail lengths of said one rail are longitudinally offset from junctions between rail lengths of the other rail of said pair, for welding of the adjacent ends to form a continuous rail, each rail of said pair having a base, a rail head and a web interconnecting said rail head to said base, the apparatus comprising a telescopic member having respective ones of a pair of plates arranged on opposed ends thereof, said plates being arranged to engage respective inner surfaces of the webs of the rails, means for locking said telescopic member at a pre-determined spacing of said plates, clamping means on respective ends of said telescopic member including a clamping plate for opposing said plate of said member to clamp the web therebetween, said clamping plate being adjustable by a screw, said screw and clamping plate being carried by a rigid link member arranged to extend over said rail head when said plate and clamping plate are in engagement with said web, and means for jacking said clamping means at one end of said telescopic member in a vertical direction to raise said rail end to a required elevation.

According to a third aspect of the invention there is provided a method for aligning adjacent rail ends a method for aligning adjacent rail ends of rail lengths of one rail of a railway track of the type having a pair of parallel spaced discontinuous rails in which junctions between rail lengths of said one rail are longitudinally offset from junctions between rail lengths of the other rail of said pair for welding of the adjacent rail ends to form a continuous rail, the method comprising attaching from said one rail to the other rail of the pair of first and a second clamping member each arranged adjacent to but spaced from said adjacent ends on a respective side thereof, each clamping member being arranged to space the rails at a pre-determined distance and to clamp said rails at said pre-determined distance.

The present invention therefore makes use of the fact that the junction of one rail where two ends abut or lie adjacent is off-set from the junctions of the parallel rail so that immediately adjacent a junction lies a continuous portion of the adjacent rail which is accurately located. Two clamping members therefore are arranged from this continuous portion of rail to the rail ends on either side of the junction so as to accurately locate the rail ends relative to one another and relative to the continuous portion ofthe other rail for the welding.

The accurate location obtained can properly orient the rail end so that any twist about the axis of the rail is eliminated and the rail ends are properly oriented vertically, horizontally and around the axis of the rail.

A jacking device can be provided for lifting the clamping member adjacent the rail end so that the rail ends are lifted from the horizontal at the adjacent ends. This lifting is necessary to accommodate the expansion and contraction obtained during the welding technique. Preferably the jacking arrangement comprises a screw which passes through the clamping member and at the same time this screw can be used to lock telescopic portions of the clamping member at the required accurate spacing of the rails. The telescopic portions can be retracted to release the clamping member from the rail web and pass over the head of the rail for use at the next position.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWING

In the drawings like characters of reference indicate corresponding parts in the different figures.

DETAILED DESCRIPTION

Figure 1:
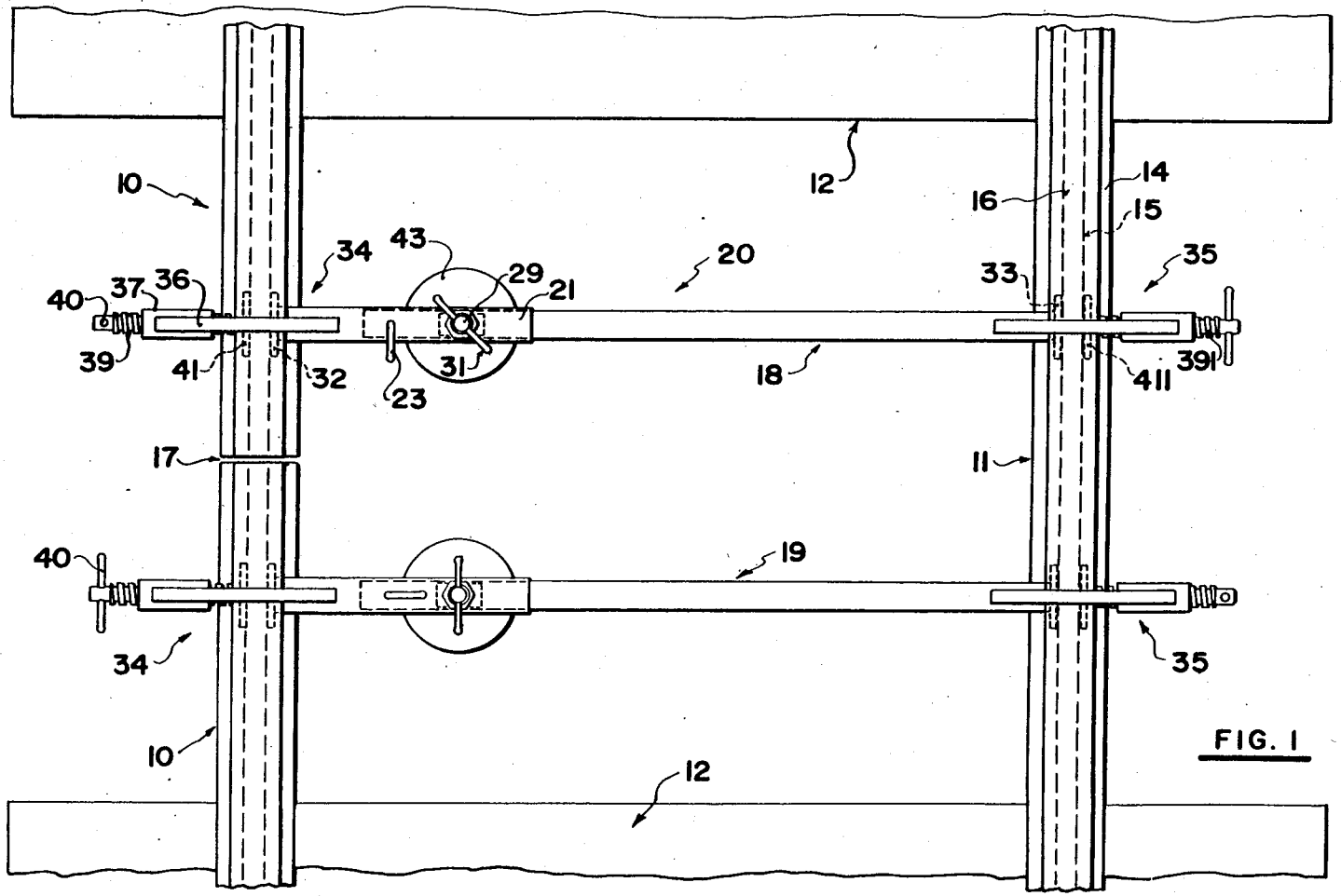
FIG. 1 is a plan view of the apparatus according to the invention in position on a rail track.
Figure 3:
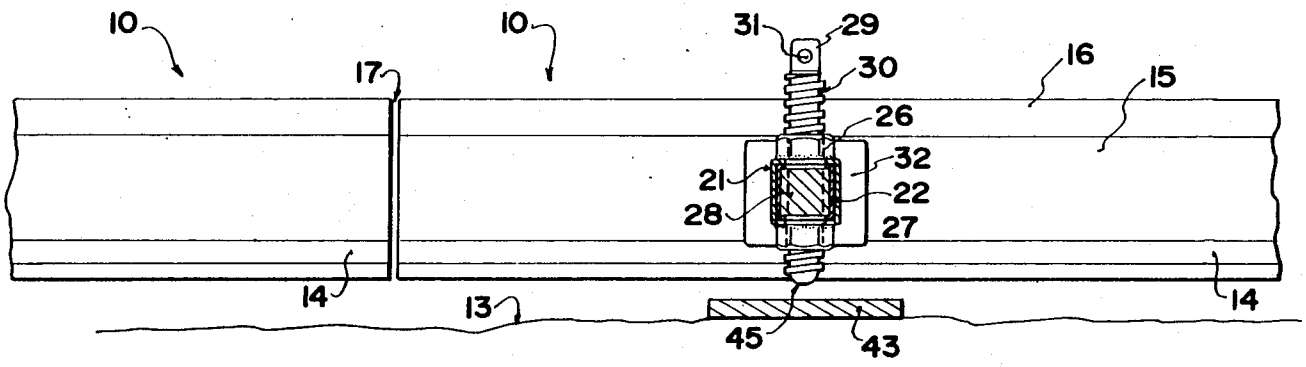
FIG. 3 is a cross-sectional view along the lines 3—3 of FIG. 2.

A rail track is shown in FIG. 1 including a pair of rails 10 and 11 which are mounted at a predetermined spacing on rail ties 12 which are spaced longitudinally of the track and interspersed with a ballast material 13.

Figure 2:
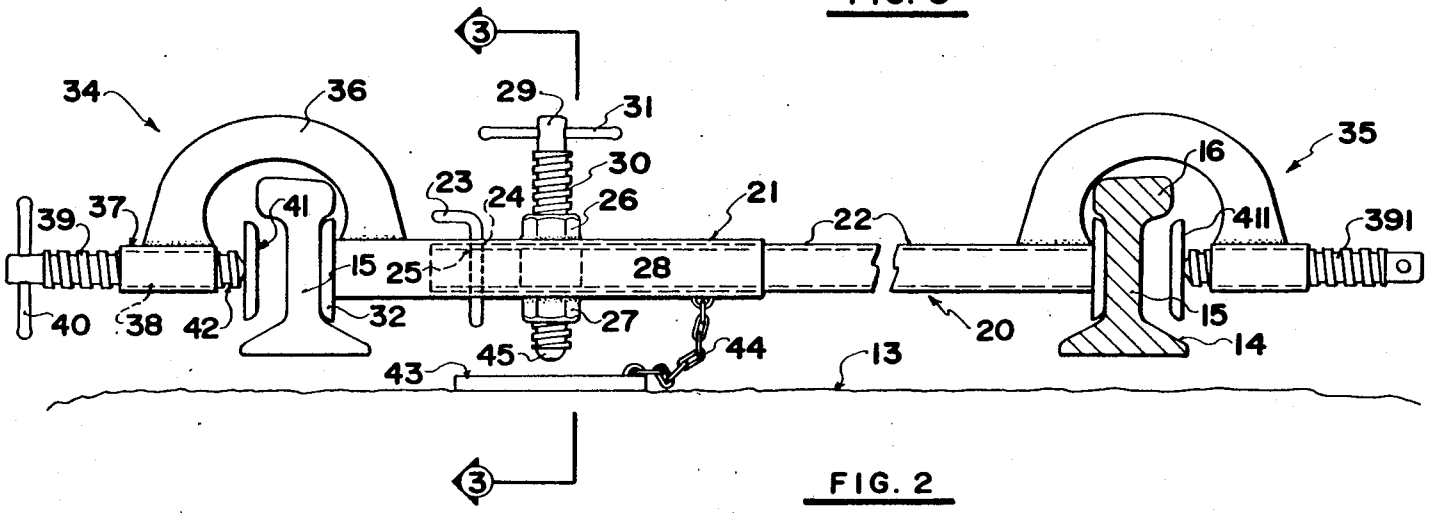
FIG. 2 is a side elevational view of the apparatus of FIG. 1.

The rails are shown in cross-section in FIG. 2 and as is well known include a base or flange 14, a web 15 and a head 16. When laid on the ties 12 the rails are generally formed in sections or lengths with a junctions between the lengths one of which is indicated at 17. In general practice the junctions in the rail 10 are off-set from the junctions in the rail 11 by approximately one-half the length of a rail section so that directly opposite the junction 17 is a portion of continuous rail of the rail 11. In addition the junctions at 17 are off-set from the ties 12 in order to give opportunity for the adjacent rail ends to flex as the rolling stock moves over the junction. The rails are affixed to the ties and the rail ends are coupled together by techniques which are well known in the art and therefore need not be described here.

There is currently an ongoing program to weld all the junctions between rails to provide continuous rail for various reasons which are also well known in the art.

The present invention therefore provides a clamping arrangement for locating the rail ends at the junction 17 for the welding technique. There is therefore provided two identical clamping devices 18 and 19 one of which will be described in detail.

The device comprises a telescopic portion 20 formed by two tubular members 21 and 22 both of square cross-section and arranged so that latter can slide within the former to expand and retract the outer ends of the telescopic member 20. The telescopic member 20 can be locked at an expanded position initially by a pin 23 which passes through openings 24, 25 in the inner and outer tubes 21, 22. The pin is used to initially locate the telescopic member in the required locked position. In addition the outer tube 21 carries a first and a second nut portion 26, 27 on the upper and lower sides respectively welded to the outer surface thereof. The inner tube 22 carries a nut 28 internally thereof and having a bore arranged in a vertical orientation so that it can align with the bores of the nut portions 26 and 27 in the lock position of the telescopic member 20. A screw 29 with a universal thread 30 can pass through the nuts in screw threaded corporation therewith when the nut 28 is aligned with the nut portions 26 and 27 so as to be exposed at the lower face of the nut portion 27 and to lock the tubular portions in the locked position of the telescopic member 20. The nuts and screw thus can lock the position but prevent reaming of an opening as would occur if locking was provided merely by the pin 23.

It will of course be apparent that when the screw 29, which carries a hand lever 31 is removed from the nuts and the pin 23 is removed from the openings the telescopic member can be retracted to reduce the spacing between the ends.

Each end of the telescopic member carries a plate 32, 33 shaped and arranged to engage the inner facing surface of the web 15. The plates 32, 33 are rectangular and have a vertical dimension sufficient to sit between the head 16 and the flange 14 so as to effectively grasp the rail at the full vertical extent of the web 15. The horizontal dimension of the plate 32, 33 is sufficient merely to engage the rail over a length which will properly grasp the rail and prevent twisting of the rail about an axis longitudinal of the telescopic member 20.

A clamping member is arranged on each end of the telescopic member 20 and generally indicated at 34, 35. The clamping member comprises a rigid link or loop 36 which is smoothly curved to avoid stress points which can bend under the clamping forces and is welded to the end of the telescopic member immediately rearward or inside the plate 32. The outer end of the link 36 carries a boss 37 which has an internal universal screw thread 38 for co-operation with a screw 39 which can be actuated by a hand lever 40 to jack the screw inwardly and outwardly. The screw carries a plate 41 similar to the plate 32 so that the plates can co-operate to clamp opposing edges of the web 15. The plate 41 of the left hand clamping member 34 as shown in FIG. 2 is mounted on a swivel coupling 42 to allow some twisting of the plate 41 relative to the boss 37 and therefore to the plate 32. The plate 411 of the clamping member 35 is rigidly coupled to the screw 391 since little twisting is required at the continuous rail end of the member.

A flat plate 43 is coupled to the member at a convenient point by a chain 44 so as to remain loosely coupled to the member for use therewith. The plate thus can be positioned on the ballast adjacent the rail for engaging a lower most end of the screw 29 indicated at 45 so that the screw 29 can be used to jack the member and thus the clamping arrangement of the left hand end thereof upwardly and downwardly to properly align the rail ends at the junction 17.

In operation the pin 23 and screw 29 are removed from the locking position and the telescopic member 20 is retracted to allow the plates 32, 33 to pass over the heads 16 of the rails 10 and 11 into the position shown in FIGS. 1 and 2. The telescopic member 20 is then expanded to the pre-determined spacing which accurately locates the rails at the required gauge. At this time the pin 23 is inserted into the openings 24, 25 to initially locate the telescopic member following which the screw 29 is applied through the aligned nuts 26, 28, 27 to lock the telescopic member at the pre-determined spacing. At this time or prior to this time the conventional pins locking the rail 10 to the ties are removed to loosen the rail ends so that they can be properly located. In addition the plates coupling the ends at the junction 17 are removed. The ends of the rail 10 are then properly adjusted for spacing relative to the continuous rail 11 and then the screws 39 and 391 are actuated to clamp the rails at that required spacing. The plates 32 and 41 thus accurately locate the ends of the rail 10 to prevent twisting about an axis longitudinal of the rail and to prevent movement in a vertical or horizontal direction. Final adjustment can be obtained by increasing or reducing the clamping force so that the rail end faces at the junction 17 are accurately over lying.

At this stage the screw 29 is actuated against the plate 43 to jack the rail ends slightly upwardly to a shallow angle. This slight upward incline which can be measured using a straight edge laid across the rail and is required in view of the expansion and contraction which occurs during the welding technique as previously explained. Techniques for measuring the required inclination are known. The spacing between the clamping device 18 and 19 and the junction 17 is just sufficient to receive the welding mold arrangement so that the rail is effectively and closely clamped adjacent its ends.

Since various modifcations can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. Apparatus for use in aligning adjacent ends of rail lengths of one rail of a railway track, of the type having a pair of parallel spaced discontinuous rails in which junctions between rail lengths of said one rail are longitudinally offset from junctions between rail lengths of the other rail of said pair, for welding of the adjacent ends to form a continuous rail, each rail of said pair having a base, a rail head and a web interconnecting said rail head to said base, the apparatus comprising a telescopic member having respective ones of a pair of plates arranged on opposed ends thereof, said plates being arranged to engage respective inner surfaces of the webs of the rails, means for locking said telescopic member at a pre-determined spacing of said plates, clamping means on respective ends of said telescopic member including a clamping plate for opposing said plate of said member to clamp the web therebetween, said clamping plate being adjustable by a screw, said screw and clamping plate being carried by a rigid link member arranged to extend over said rail head when said plate and clamping plate are in engagement with said web, and means for jacking said clamping means at one end of said telescopic member in a vertical direction to raise said rail end to a required elevation.

2. The invention according to claim 1 wherein the jacking means comprises a screw and a pair of nuts on said telescopic member arranged to be aligned only at said pre-determined spacing whereby said screw locks said telescopic member in said pre-determined spacing and passes therethrough for jacking said telescopic member relative to ballast adjacent said rail.

3. Apparatus for use in aligning adjacent ends of rail lengths or one rail of a railway track, of the type having pair of parallel spaced discontinuous rails in which junctions between rail lengths of said one rail are longitudinally offset from junctions between rail lengths of the other rail of said pair, for welding of the adjacent ends to form a continuous rail, each rail of said pair having a base, a rail head and a web interconnecting said rail head to said base, the apparatus comprising a pair of rail clamp devices, each device including a telescopic member having respective ones of a pair of plates arranged on opposed ends thereof, said plates being arranged to engage respective inner surfaces of the webs of the rails, means for locking said telescopic member at a predetermined spacing of said plates, clamping means on respective ends of said telescopic member including a clamping plate for opposing said plate of said member to clamp the web therebetween, means for adjusting the spacing between said clamping plate and said plate so that said clamping plate is movable from a clamping position to a released position in which the spacing therebetween is greater than the width of the head, said adjusting means and clamping plate being carried by a rigid link member arranged to extend over said rail head when said plate and clamping plate are in engagement with said web, and means for jacking said clamping means at one end of said telescopic member in a vertical direction to raise said rail end to a required elevation.

4. The invention according to claim 3 wherein said locking means comprises a first nut on one portion of said telescopic member and a second nut on a second portion thereof, and a bolt for passing through the nuts in screw threaded co-operation therewith when aligned so as to lock said nuts in said aligned position at said pre-determined spacing.

5. The invention according to claim 4 including a pin and a pair of holes in said first and second portions which are aligned at said pre-determined spacing for receiving said pin.

6. The invention according to claim 3 including a loosely attached plate member for positioning on the ballast at said jacking means for receiving force from said jacking means.

* * * * *